US010047453B2

(12) United States Patent
Woodruff et al.

(10) Patent No.: US 10,047,453 B2
(45) Date of Patent: Aug. 14, 2018

(54) ELECTROPLATING APPARATUS

(71) Applicant: APPLIED Materials, Inc., Santa Clara, CA (US)

(72) Inventors: Daniel J. Woodruff, Kalispell, MT (US); Gregory J. Wilson, Kalispell, MT (US); Paul R. McHugh, Kalispell, MT (US)

(73) Assignee: Applied Materials, Inc., Santa Clara, CA (US)

( * ) Notice: Subject to any disclaimer, the term of this patent is extended or adjusted under 35 U.S.C. 154(b) by 510 days.

(21) Appl. No.: 14/721,693

(22) Filed: May 26, 2015

(65) Prior Publication Data

US 2016/0348263 A1 Dec. 1, 2016

(51) Int. Cl.

| | |
|---|---|
| ***C25D 17/18*** | (2006.01) |
| ***C25D 17/00*** | (2006.01) |
| ***C25D 21/10*** | (2006.01) |

(52) U.S. Cl.

CPC ..... *C25D 17/001* (2013.01); *C25D 17/002* (2013.01); *C25D 17/008* (2013.01); *C25D 21/10* (2013.01)

(58) Field of Classification Search

CPC ..... C25D 17/18; C25D 17/001; C25D 17/02; C25D 17/005

USPC ..... 204/214

See application file for complete search history.

(56) References Cited

U.S. PATENT DOCUMENTS

| | | | |
|---|---|---|---|
| 6,398,926 | B1 | 6/2002 | Mahneke |
| 6,557,237 | B1 | 5/2003 | Olgado |
| 8,496,789 | B2 | 7/2013 | McHugh et al. |
| 8,968,533 | B2 | 3/2015 | Harris et al. |
| 2002/0053510 | A1 | 5/2002 | Woodruff et al. |
| 2007/0261964 | A1 | 11/2007 | Wilson et al. |
| 2011/0042224 | A1 | 2/2011 | McHugh et al. |
| 2014/0151218 | A1 | 6/2014 | Woodruff |
| 2015/0075976 | A1 | 3/2015 | Harris et al. |

FOREIGN PATENT DOCUMENTS

| | | | |
|---|---|---|---|
| JP | 2006328470 | A | 12/2006 |

OTHER PUBLICATIONS

ISA/KR, International Application Division, Korean Intellectual Property Office, The International Search Report and the Written Opinion of the International Searching Authority issued in International application No. PCT/US2016/033878 (dated Aug. 8, 2016).

*Primary Examiner* — Zulmariam Mendez

(74) *Attorney, Agent, or Firm* — Perkins Coie LLP; Kenneth H. Ohriner

(57) ABSTRACT

An electroplating processor includes a base having a vessel body. A membrane assembly including a membrane housing is attached to a membrane plate. A membrane is provided on a membrane support attached to the membrane housing. An anode assembly includes an anode cup and one or more anodes in the anode cup. An anode plate is attached to the anode cup. Two or more posts on a first side of the anode plate are engageable with post fittings on the membrane plate. Latches on a second side of the anode plate are engageable with and releasable from a latch fitting on the membrane plate. The anode assembly is quickly and easily removable from the processor for maintenance, without disturbing or removing other components of the processor.

15 Claims, 8 Drawing Sheets

ELECTROPLATING APPARATUS

The field of the invention is electroplating wafers and similar substrates in the manufacture of micro-scale devices, such as semiconductor devices.

BACKGROUND OF THE INVENTION

Micro-scale devices including semiconductor devices, are generally fabricated on a wafer or other substrate. In a typical fabrication process, one or more layers of metal are formed on the wafer in an electroplating processor by passing electric current through an electrolyte causing metal ions in the electrolyte to plate out onto the wafer. The electroplating processor requires periodic maintenance, to replace consumed anodes, and for other reasons. Consequently the processor is advantageously designed to provide for quick and simplified access to processor components, as well as to reduce the need for maintenance. Preventing bubble formation in the electrolyte also helps improve processor performance. These factors present engineering challenges in electroplating processor design and operation.

SUMMARY OF THE INVENTION

In a first aspect, an electroplating processor or apparatus includes a base having a vessel body. A membrane assembly includes a membrane housing attached to a membrane plate. A membrane is provided on a membrane support attached to the membrane housing. An anode assembly includes an anode cup and one or more anodes in the anode cup. An anode plate is attached to the anode cup. Two or more posts may be provided on a first side of the anode plate, with each post engageable with a post fitting on the membrane plate. One or more latches on a second side of the anode plate are engageable with and releasable from a latch fitting on the membrane plate. The anode assembly is quickly and easily removable from the processor for maintenance, without disturbing or removing other components of the processor.

In another aspect, the vessel body, the membrane assembly and the anode assembly form a vessel having an upper chamber above the membrane and a lower chamber below the membrane. A paddle in the upper chamber is supported by first and second drive arms on a first side of the paddle and by at least one follower arm on a second side of the paddle. The first and second drive arms are connected to a motor which drives the paddle in an oscillating motion in the electrolyte in the upper chamber. The paddle alignment is maintained as the paddle is supported at three or more positions.

DETAILED DESCRIPTION OF THE DRAWINGS

Figure 1:
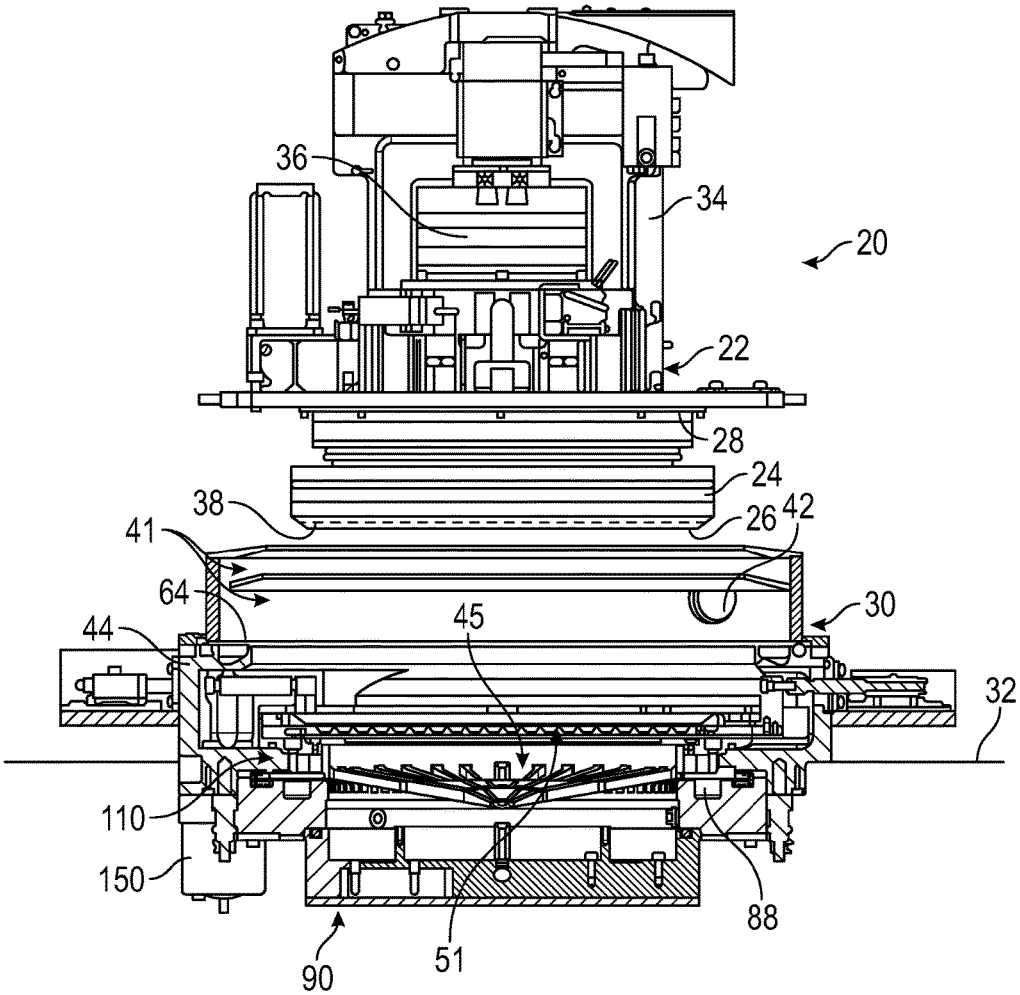
FIG. 1 is a section view of an electroplating processor.

As shown in FIG. 1, an electroplating processor 20 includes a head 22 and a base 30. Multiple processors 20 are typically provided within a processing system enclosure, with a system robot in the enclosure moving wafers into and out of the processors. The base 30 of the processor may be precisely located on and supported by a deck 32 of the processing system. The head 22 is aligned over the base 30. The head 22 may include a rotor 28 on a lift-tilt assembly 34. A chuck 24 holding a wafer 26 is attachable onto and removable from the rotor 28, typically via the system robot. A contact ring 38 in the chuck 24 has contact fingers that make electrical contact with the down-facing side of the wafer 26. A motor 36 rotates the rotor 28 holding the chuck 24 and the wafer 26 during processing. FIG. 1 shows the processor loaded with a wafer 26, while in the remaining figures the wafer is omitted for clarity of illustration.

Figure 2:
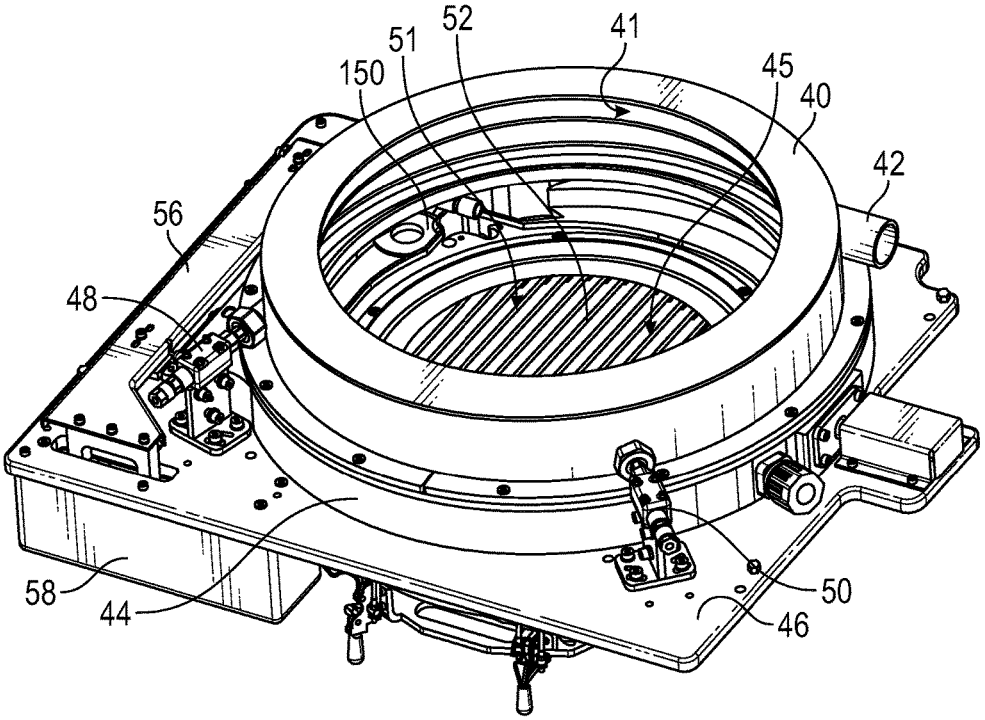
FIG. 2 is a top and front perspective view of the base of the processor shown in FIG. 1.

Referring to FIGS. 1 and 2, the base 30 has a rinse rim 40 on a vessel body 44. The rinse rim may have one or more internal rinse liquid drain channels 41 and an exhaust line 42. The rinse rim 40 may be transparent, to better allow direct viewing into the processor 20. The rinse rim 40 may be a rigid plastic component fixed in position on the vessel body 44, and having no moving parts. The base 30 may be attached to a base plate 46, with the base plate attached to the deck 32. A chuck rinse nozzle assembly 48 on the base plate 46 may be adjusted to aim a spray or jet of rinse liquid at the chuck 24. Similarly, a wafer rinse nozzle assembly 50 on the base plate 46 may be adjusted to aim a spray of rinse liquid at the wafer 26. Each nozzle assembly 48 and 50 may have a nozzle which passes through and seals against the rinse rim 40, to contain rinse liquid within the processor 20. With the chuck rotated on the rotor, and by optionally tilting the rotor via the lift-tilt assembly, the chuck 24 and the wafer 26 may be effectively rinsed after processing.

Figure 3:
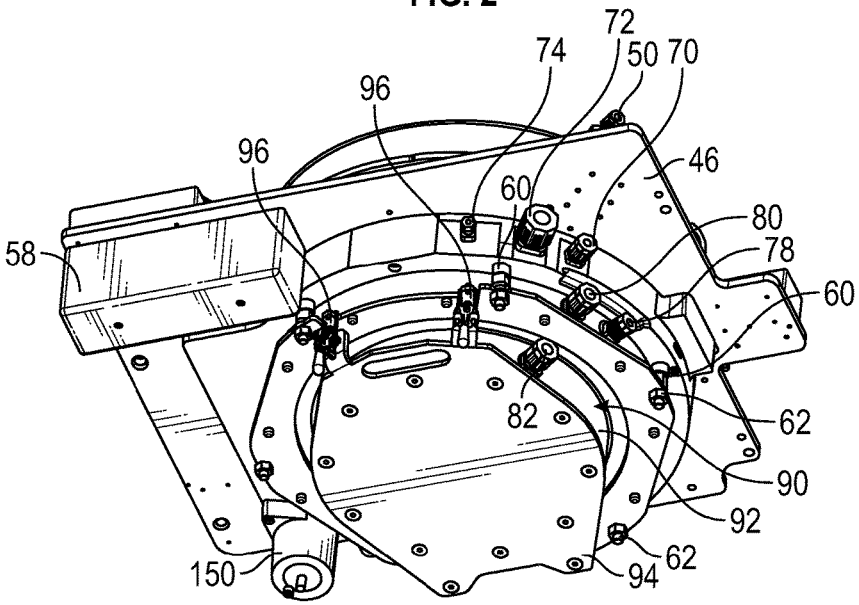
FIG. 3 is a bottom and front perspective view of the base of the processor shown in FIGS. 1 and 2.
Figure 4:
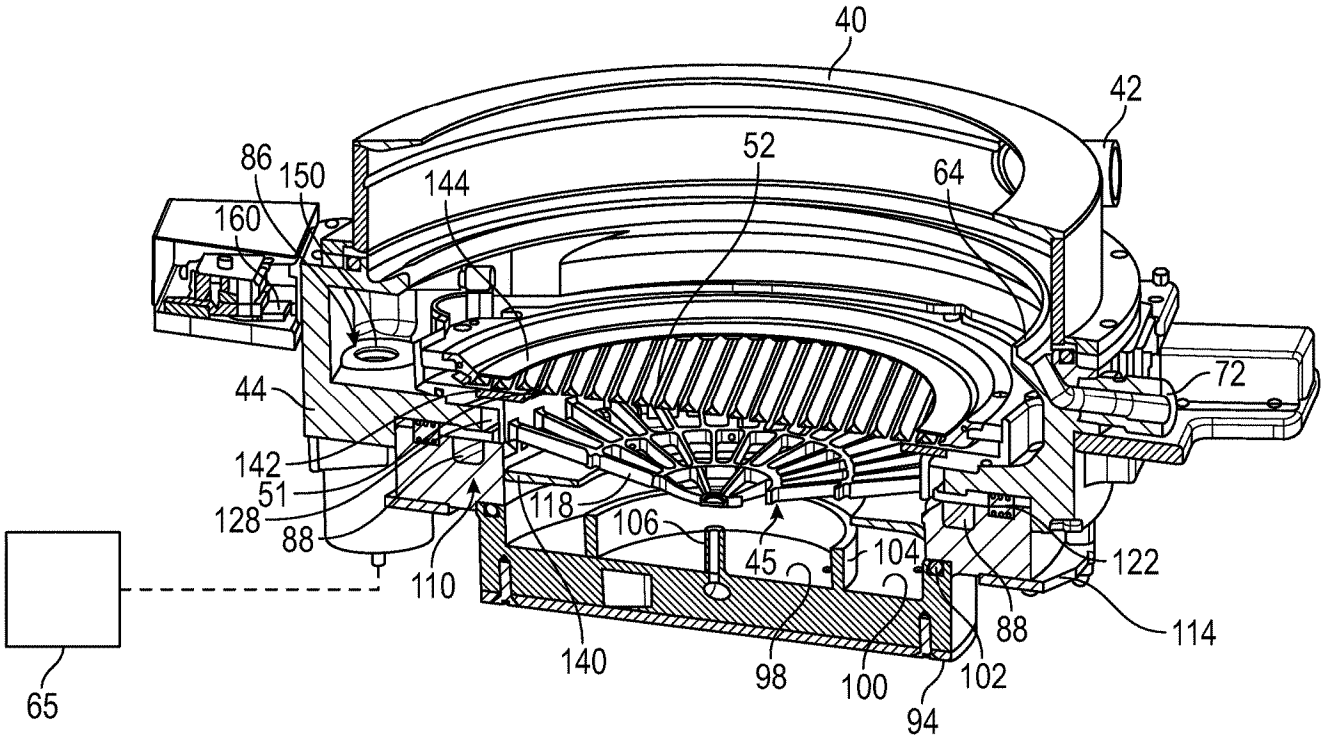
FIG. 4 is a section view of the base of the processor shown in FIGS. 1-3.
Figure 6:
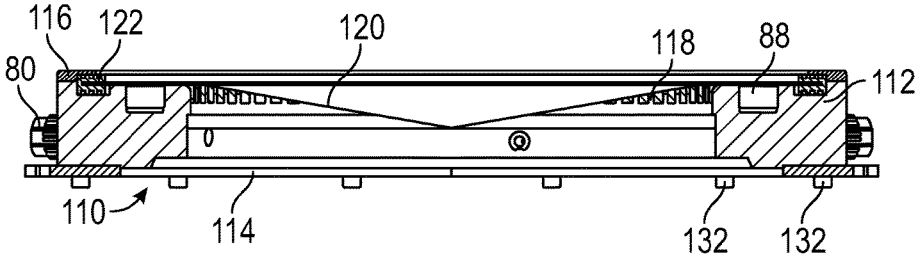
FIG. 6 is a section view of the membrane assembly shown in FIGS. 1, 4 and 5.

Turning to FIGS. 3, 4 and 6, a membrane assembly 110 is attached to a bottom surface of the vessel body 44, and an anode assembly 90 is attached to the bottom surface of the membrane assembly 110. The membrane assembly 110 includes a membrane housing 112 attached to a membrane plate 114, and a membrane 120 on a membrane support 118 attached to the membrane housing 112.

The vessel body 44, the membrane assembly 110 and the anode assembly 90 form a vessel 45 having an upper chamber above the membrane 120 and a lower chamber below the membrane 120. The upper chamber is supplied with a first liquid electrolyte referred to as catholyte and the lower chamber is filled with a second liquid electrolyte referred to as anolyte. A paddle 51 in the upper chamber oscillates during processing to increase electroplating performance.

Figure 7:
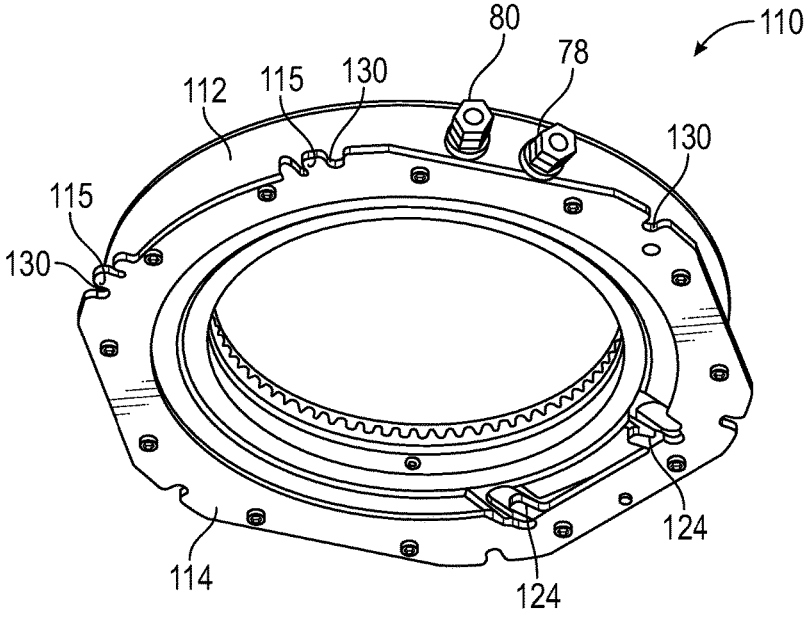
FIG. 7 is a bottom perspective view of the membrane assembly shown in FIG. 6.
Figure 8:
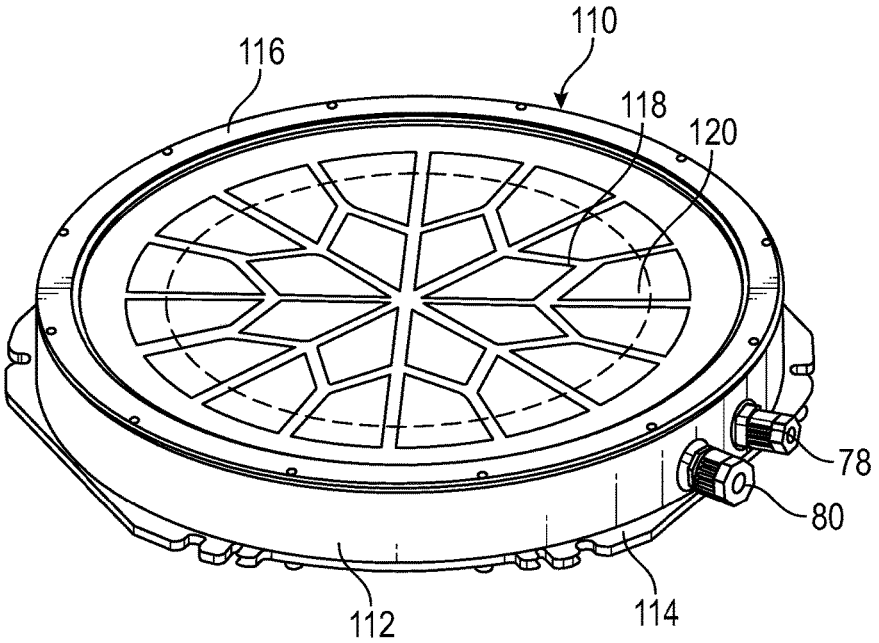
FIG. 8 is a top perspective view of the membrane assembly shown in FIGS. 6 and 7

Referring momentarily to FIGS. 6, 7 and 8, in the membrane assembly 110, the membrane housing 112 may be a plastic material such as natural polypropylene (NPP)

clamped via bolts 132 between the membrane plate 114 on the bottom and a membrane ring 116 at the top. The membrane plate 114 may be a rigid flat metal plate, e.g., 2-5 mm steel, with the membrane ring 116 of similar design, providing a rigid membrane assembly 110 having improved sealing characteristics.

The membrane support 118 may have a web-like or open frame structure made of a dielectric material, to reduce the influence of the membrane support 118 on the electric field within the vessel 45. An annular membrane seal 122 in a groove at the top surface of the membrane housing 112 seals the membrane 120 onto the membrane housing 112. The membrane 120 provides a barrier to liquid flow, separating the anolyte in the lower chamber from the catholyte in the upper chamber, while allowing specific ions to pass through. In many applications, the membrane 120 is an ionic membrane which selectively passes certain ions while otherwise providing a barrier. In other applications, for example with plating nickel where the anolyte and the catholyte may be the same, the membrane may simply be a filter which keeps anode particulates away from the wafer, but which is not ion-selective. An aspiration line may run through or alongside the membrane support 118 to the lowest point in the upper chamber, to remove all catholyte from the processor 20.

Figure 9:
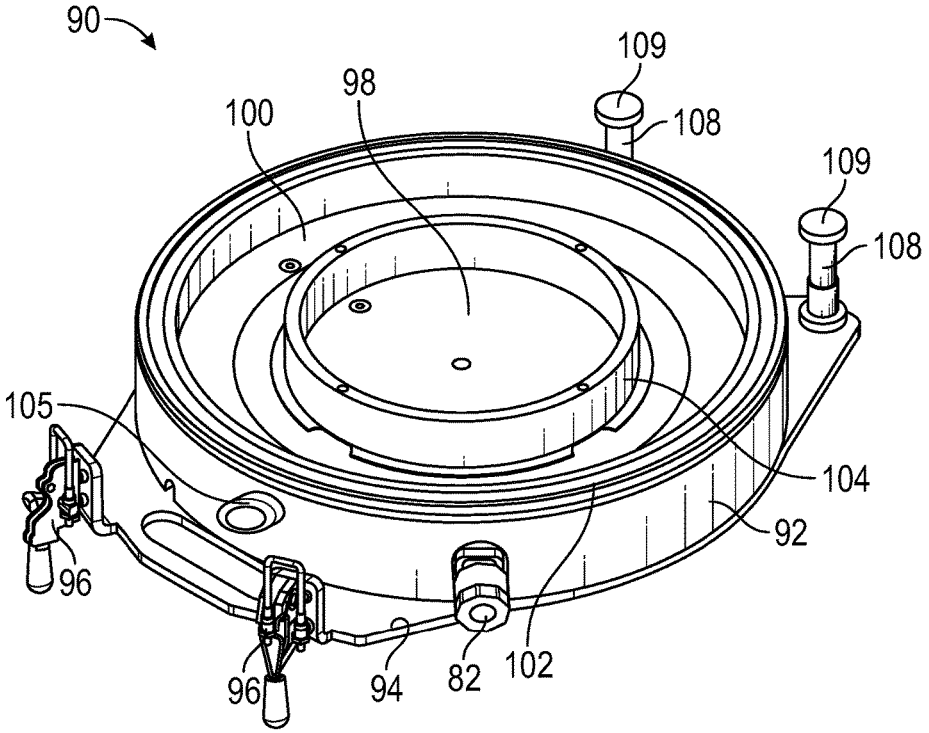
FIG. 9 is a top perspective view of the anode assembly shown in FIGS. 1, 4 and 5.
Figure 11:
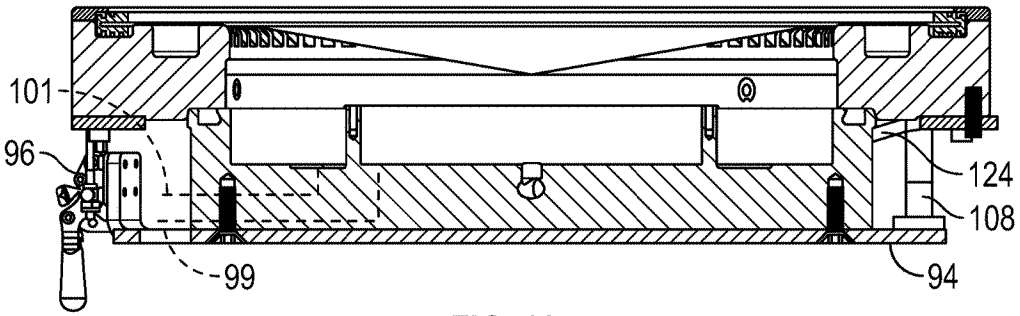
FIG. 11 is a section view showing attachment of the anode assembly to the membrane assembly.

Turning to FIGS. 3 and 9, the anode assembly 90 includes an anode cup 92 attached to an anode plate 94. The anode cup 92 may be a plastic material such as natural polypropylene. The anode plate 94 may be a rigid metal plate, e.g., 2-5 mm steel. As shown in FIG. 9, the anode cup 92 may have an inner anode compartment 98 concentric with an outer anode compartment 100, with a ring wall 104 between them. In use, bulk anode material, such as bulk or particulate copper or other metal, are placed in the anode compartments 98 and 100, to provide a source of plating material. As shown in FIGS. 9 and 11, electrical connections are made to the inner and outer anode compartments 98 and 100 via cables or conductors 99 and 101 leading to a connector 105 on the sidewall of the anode cup 92. The bulk metal in the compartments 98 and 100 provides an inner anode and an outer anode.

Figure 5:
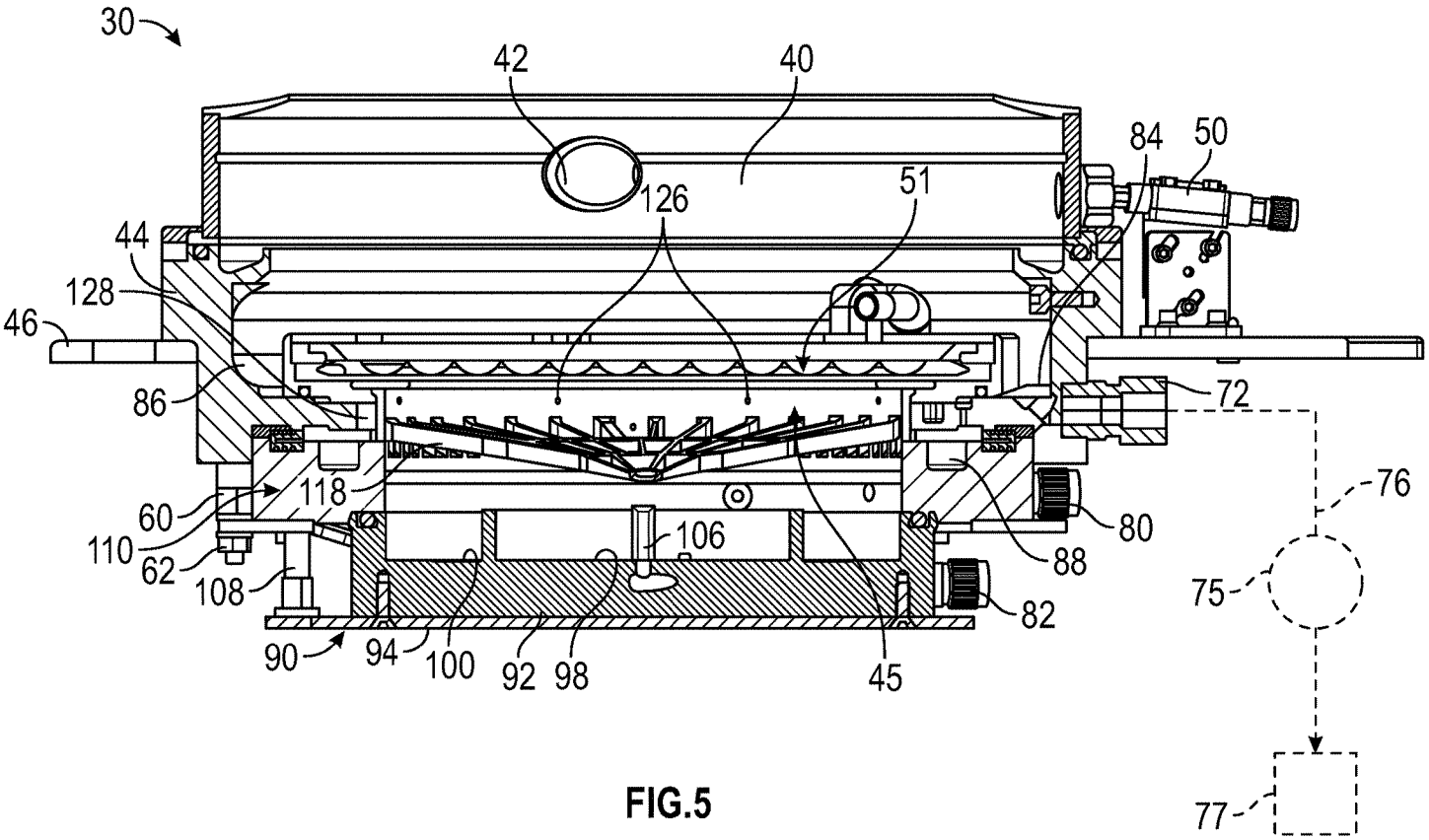
FIG. 5 is a rotated section view of the base of the processor shown in FIGS. 1-3.

Referring back to FIG. 9, a seal, such as an o-ring 102 is provided at the top perimeter of the anode cup 92. Latches 96 are attached to front of the anode plate 94. Posts 108 are attached to the back of the anode plate 94, with each post having a cap 109. As shown in FIGS. 4 and 5, a center inlet 106 may be positioned at the center of the anode cup 92 and supplied with anolyte via the anolyte supply port 82. Anolyte is distributed within the lower chamber from the center inlet 106 and moves out of the lower chamber radially via the anolyte drain channel 88. The flow path of the anolyte and the angle of the membrane help to entrain and carry away any trapped gas or bubbles from the membrane 120, so that the gas or bubbles do not disturb the electric field in the vessel 45.

Referring to FIG. 3, the upper chamber of the vessel 45 is supplied with a flow of catholyte via a catholyte supply port 70 and a catholyte return port 72 in the vessel body 44, connected to a catholyte supply system typically including one or more pumps, storage tanks, filters, heaters and other components. A maintenance drain port 74 may also be provided in the vessel body 44, to allow catholyte to be drained out of the upper compartment without affecting the catholyte supply system. Referring still to FIG. 3, an anolyte idle state inlet port 78 and an anolyte process return port 80 are provided on the membrane housing 112, while an anolyte supply port 82 is provided in the anode cup 92. As all of the ports are clustered within a 60 degree sector at the front of the processor 20, maintenance is made easier.

The catholyte supply port 70 connects into a catholyte supply plenum or groove 128 formed between the vessel body 44 and the membrane housing 112, for supplying catholyte to radial flow ports 126 in the vessel body 44. As shown in FIGS. 4 and 5, the catholyte return port 72 leads into a catholyte drain channel 86 in the vessel body 44, with a screen 84 optionally positioned at the junction of the catholyte drain channel 86 and the catholyte return port 72. During processing catholyte flows over a weir 64 in the vessel body 44 and into the catholyte return port 72. The weir 64 sets the vertical position of the surface of the catholyte in the upper chamber.

Also as shown in FIG. 5, an anolyte drain channel 88 is formed in the membrane housing 112. In FIG. 4, an annular anode shield 140 may be provided below the membrane support 118 in the lower chamber. An annular chamber shield 142 may be provided above the membrane 120, just below the paddle 51, and an annular wafer shield 144 may be provided on the vessel body 44 just above the paddle 51. Each shield, if used, is an annular dielectric component positioned and dimensioned to influence the electric field in the vessel during processing. The processor 20 may be converted to electroplate wafers of different diameter by changing the shields. In some cases one or more of the shields may have a non-round shape, to provide asymmetric shielding.

Figure 10:
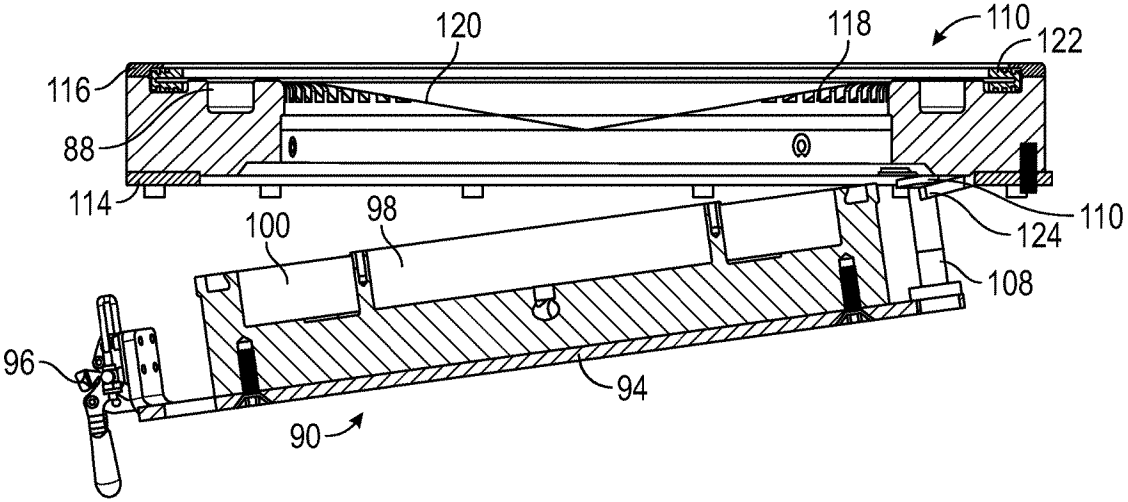
FIG. 10 is a section view showing removal of the anode assembly from the membrane assembly.

As shown in FIGS. 1, 3 and 5, the membrane assembly 110 is attached to and sealed against the vessel body 44 via threaded standoffs 60 on the bottom of the vessel body 44 projecting through holes or slots 130 in the membrane plate 114, secured with nuts 62. The membrane plate 114 includes two or more post fittings 124 at the back of the membrane plate 114, for receiving and holding the posts 108 on the anode plate 94, when the anode assembly 90 is attached to the membrane assembly 110. Latch fittings 115 are provided at the front of the membrane plate 114. Referring to FIGS. 7, 10 and 11, the post fittings 124 may be provided in the form of a projection or finger extending downward from the plane of the membrane plate 114 at an acute angle.

Figure 12:
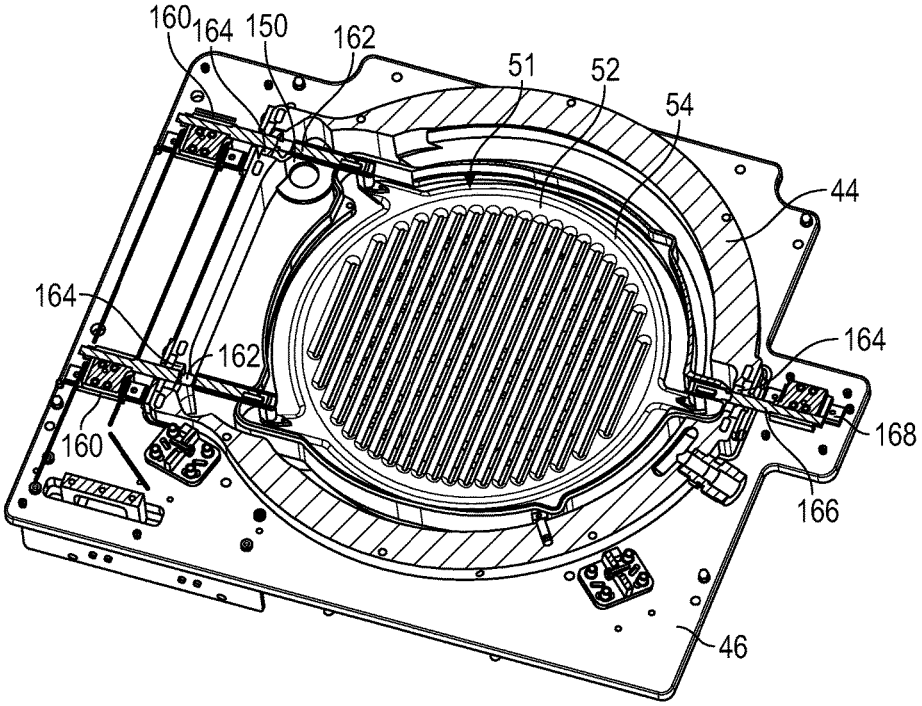
FIG. 12 is a top perspective view of the base of the processor shown in FIGS. 1, 4 and 5, with components removed for purpose of illustration.

As shown in FIGS. 4 and 12, a paddle 51 in the upper chamber includes a paddle insert 52 on a paddle frame 54. The paddle insert 52 is a dielectric material, while the paddle frame 54 is typically metal or plastic. The paddle frame 54 is supported by first and second drive arms 162 on a first side of the paddle frame 54, and by at least one follower arm 166 on a second side of the paddle. The first and second drive arms 162 are secured to and slide on drive rails 160 supported on the base plate 46. The follower arm 166 is similarly secured to and slides on a follower rail 168 on the base plate 46. The paddle can be precisely levelled by adjusting the height of the drive rails 160 and the follower rail 168. A bellows 164 on each drive arm 162 and follow arm 166 seals liquids and vapors in the vessel 45 away from external components. A paddle motor 58, which may be a linear motor, is contained within a motor housing 56 and is mechanically linked to the drive arms 162. The paddle motor 58 moves the paddle 51 in the catholyte in the upper chamber. This movement may be an oscillating movement, or the controller 65 may operate the paddle motor 58 to provide other patterns of paddle movement.

Turning to FIGS. 4 and 5, a pressure or level sensor 150 in the vessel body 44 senses the level of catholyte in the catholyte drain channel 86 and provides a liquid level signal to an electronic controller or computer 65. Based in whole or part on the liquid level signal, the computer 65 controls a servo valve 75 in the catholyte return line 76 connected to the catholyte return port 72. The computer 65 operates the servo valve 75 to keep the catholyte return line 76 filled with catholyte at all times, to reduce or avoid formation of air bubbles in the catholyte. Specifically, the catholyte return line 76, from the level of catholyte in the catholyte drain channel 86 to the level of catholyte in the catholyte tank 77, is maintained full of catholyte, even with large variations of the catholyte level in the catholyte drain channel 86 caused by a wafer 26 rapidly plunging into and withdrawing from the catholyte bath in the upper chamber.

In use, a wafer chuck 24 holding a wafer 26 is attached to the rotor 28 via a robot, while the rotor is horizontal. A conductive seed layer on the wafer 26 is biased with a negative voltage via a negative voltage source electrically connected to the wafer 26 via the contact ring 38. The lift-tilt assembly 34 is movable to tilt the wafer 26 to an acute angle, generally in the range of 1-15 degrees, and lowers the wafer 26 into the catholyte in the upper chamber of the vessel 45. The lower chamber of the vessel 45 is filled with anolyte. Catholyte and anolyte flow through the vessel during processing. Positive voltage is applied to the anode material, e.g., copper, in the anode cup 92. Ions of the anode material move from the anode cup, through the anolyte and through the membrane 120 and into the catholyte in the upper chamber, with the ions depositing onto the wafer 26 to create a metal layer on the wafer 26. The rotor 28 may rotate the wafer 26 during processing. The paddle 51 oscillates back and forth under the wafer to increase mass transfer of metal ions onto the wafer 26.

After the metal layer is formed on the wafer 26, the lift-tilt mechanism 34 lifts the wafer up out of the catholyte to a position within the rinse rim 40. The chuck rinse nozzle assembly 48 applies rinse liquid onto the chuck 34 and the wafer rinse nozzle assembly 50 applies rinse liquid onto the wafer 26. Rinse liquid flying off of the wafer 26 during rinsing is captured within the rinse rim 40 and removed via the exhaust line 42. The chuck 34 is then removed from the rotor 28 for subsequent processing.

Referring to FIGS. 10 and 11, when the anode material is consumed, or other maintenance is to be performed, anolyte is drained from the lower chamber, optionally via reverse flow through the anolyte supply port 82. The anode assembly 90 is removed from the processor 20 by releasing the latches 96 and pivoting the front of the anode assembly 90 away from the membrane plate 114. The clamps 96 may be over center clamps operated by hand. The back of the anode assembly 90 is held up via the posts 108 engaged with the post fittings 124 on the membrane plate 114.

With the anode assembly pivoted into the position shown in FIG. 9, the anode assembly 90 may then be pulled forward causing the posts 108 to disengage from and move out of the post fittings 124, so that the anode assembly 90 is detached from the membrane plate 114. The anode cup 92 may then be refilled with anode material. The anode assembly 90 is reinstalled onto the processor 20 using the reverse sequence of steps. As this occurs the o-ring 102 is tightly compressed against the membrane plate 114 to seal the anode cup 92 against the membrane plate 114. The compression applied to the o-ring is set by precise dimensional control of the length of the posts 108.

The membrane assembly 110 generally does not require maintenance, unless the membrane is damaged. In this case, the membrane assembly 110 may be removed from below the deck 32 by loosening or removing the nuts 62 on the threaded standoffs 60. Hence, the anode assembly 90 and the membrane assembly 110 may be removed without removing or disturbing the paddle 51 or the lift-tilt mechanism 34.

During a prolonged idle state, the level of anolyte in the lower chamber is advantageously lowered so that the anolyte is no longer in contact with the membrane 120, but with the anolyte still covering the anode material. This prevents a buildup of excess plating material ions in the catholyte, and prevents oxidation of the anode material. During the idle state, circulation of anolyte is changed by pumping a reduced volume of anolyte into the lower chamber via the anolyte idle state inlet port 78 and removing anolyte via reverse flow through the center inlet 106 and the anolyte supply/idle return port 82. A valve outside of the processor 20 is switched to redirect the return flow of anolyte to an anolyte tank.

Releasable or releasably means a first element can be separated or disengaged and removed from a second element by withdrawing, opening, loosening or removing one or more latches, fittings or fasteners. Rigid means the deflection of an element under typical loads as applied in the type of apparatus described is sufficiently low to avoid detectable leaking of catholyte or anolyte. The wafer 26 may be a silicon wafer or other substrate on which microelectronic, micro-electromechanical or micro-optical devices are formed. Although plating of metals is generally described above, of course, other electrically conductive materials which are not metals may also be used.

Thus, novel apparatus and methods have been shown and described. Various changes and substitutions may of course be made without departing from the spirit and scope of the invention. The invention, therefore, should not be limited, except by the following claims and their equivalents.

The invention claimed is:

1. An electroplating apparatus, comprising:

a base having a vessel body;

a membrane assembly including a membrane housing attached to a membrane plate, and a membrane on the membrane housing; and an anode assembly including an anode cup and one or more anodes in the anode cup, and an anode plate attached to the anode cup, with two or more posts on a first side of the anode plate, with each post laterally engageable with a post fitting on the membrane plate, and at least one latch on a second side of the anode plate engageable with and releasable from a latch fitting on the membrane plate.

2. The electroplating apparatus of claim 1 wherein the anode cup is at a bottom end of the vessel body, and the anode assembly is removable from the membrane assembly by releasing the at least one latch, pivoting the second side of the anode plate away from the membrane plate, and then disengaging the posts from the post fittings.

3. The electroplating apparatus of claim 1 with the vessel body, the membrane assembly and the anode assembly forming a vessel having an upper chamber above the membrane and a lower chamber below the membrane.

4. The electroplating apparatus of claim 3 with the anode assembly removable from the membrane assembly without removing the membrane.

5. The electroplating apparatus of claim 1 with the vessel body, the membrane assembly and the anode assembly forming a vessel having an upper chamber above the membrane and a lower chamber below the membrane, a drain line leading from the upper chamber to a servo valve, and a sensor in the upper chamber for sensing a liquid level in the upper chamber, and an electronic controller electrically connected to the sensor and the servo valve.

6. The electroplating apparatus of claim 1 with the vessel body, the membrane assembly and the anode assembly forming a vessel having an upper chamber above the membrane and a lower chamber below the membrane, an anode shield in the lower chamber, a paddle in the upper chamber, a chamber shield in the upper chamber below the paddle, and a wafer shield in the upper chamber above the paddle, with the anode shield, the chamber shield and the wafer shield each comprising a dielectric material.

7. The electroplating apparatus of claim 1 further including a rinse rim fixed in position on the vessel body and having an open top, and further including an exhaust line in a sidewall of the rinse rim.

8. The electroplating apparatus of claim 1 wherein the membrane plate is a flat rigid metal plate, further comprising threaded standoffs on the vessel body extending through holes or slots in the membrane plate.

9. The electroplating apparatus of claim 1 further including a drain channel in the membrane housing.

10. The electroplating apparatus of claim 1 with each post fitting including a projection extending downward at an acute angle from a plane of the membrane plate.

11. The electroplating apparatus of claim 1 with each post engageable with a post fitting via a head on the post retained by the post fitting.

12. The electroplating apparatus of claim 11 with each post movable into a slot in the post fitting to engage the post with the post fitting.

13. The electroplating apparatus of claim 12 with each post engageable with a post fitting by moving the post in a direction at least partially perpendicular to a central axis of the post.

14. An electroplating apparatus, comprising:

a base having a vessel body;

a membrane assembly including a membrane housing attached to a membrane plate, and a membrane on the membrane housing; and an anode assembly including an anode cup at a bottom end of the vessel body, and an anode plate attached to the anode cup, with two or more posts on a first side of the anode plate, with each post laterally engageable into a slot in a post fitting on the membrane plate, and at least one latch on a second side of the anode plate engageable with and releasable from a latch fitting on the membrane plate.

15. The electroplating apparatus of claim 14 wherein the anode assembly is removable from the membrane assembly by releasing the at least one latch, pivoting the second side of the anode plate away from the membrane plate, and then disengaging the posts from the post fittings.

* * * * *